United States Patent [19]

De Longchamp

[11] 4,416,599

[45] Nov. 22, 1983

[54] DIAPHRAGM PUMP WITH COMPENSATION MEANS IN THE HYDRAULIC CONTROL CHAMBER

[75] Inventor: Jacques H. De Longchamp, La Châtre, France

[73] Assignee: Dosapro Milton Roy, Point Saint Pierre, France

[21] Appl. No.: 311,256

[22] Filed: Oct. 14, 1981

[30] Foreign Application Priority Data

Oct. 17, 1980 [FR] France ..... 80 22242

[51] Int. Cl.[3] ..... F04B 43/02

[52] U.S. Cl. ..... 417/386; 417/388

[58] Field of Search ..... 417/385, 386, 387, 388

[56] References Cited

U.S. PATENT DOCUMENTS

| | | | |
|---|---|---|---|
| 2,303,597 | 12/1942 | Adelson | 417/386 |
| 2,405,734 | 8/1946 | Coe | 417/386 |
| 3,902,826 | 9/1975 | Nägel | 417/386 |
| 4,050,859 | 9/1977 | York | 417/386 |

FOREIGN PATENT DOCUMENTS

| | | | |
|---|---|---|---|
| 295905 | 9/1971 | U.S.S.R. | 417/385 |

*Primary Examiner*—Leonard E. Smith

*Attorney, Agent, or Firm*—DeLio & Libert

[57] ABSTRACT

The present invention relates to a hydraulically controlled diaphragm pump, comprising an intermediate chamber filled with fluid, and a re-filling conduit for said chamber.

According to the invention, means are provided for controlling the closing and the opening of the said conduit, which means are constituted by a valve cooperating with a fixed seat through which the said re-filling conduit reaches into the said intermediate chamber. Said valve is mounted for sliding on a rod, which rod is also mounted for sliding longitudinally inside a fixed support in the said intermediate chamber and traverses the said seat, a shoulder of the said rod forming means for moving the said valve and holding it on its seat, an actuating surface of the said rod, opposite the said shoulder, forming the rear of the diaphragm and a spring being coupled between the said support and the said actuating surface for closing the said valve.

The invention finds an application in the field of mechanical engineering.

5 Claims, 2 Drawing Figures

DIAPHRAGM PUMP WITH COMPENSATION MEANS IN THE HYDRAULIC CONTROL CHAMBER

The present invention relates to hydraulically-controlled diaphragm pumps and more particularly to the compensation device designed to keep a suitable volume of liquid inside the intermediate chamber situated between the piston and the diaphragm.

It is indeed known that, in this type of pump, a system must be provided to re-fill the chamber in question, generally from an auxiliary reservoir. This system, which is known as a compensation system, is required to keep the intermediate chamber filled with a certain volume of liquid in order to allow in all running conditions a deflection of the diaphragm which corresponds to the cubic capacity swept by the piston without any risk of the said diaphragm being damaged or the flow being perturbed.

There are two main types of re-filling devices: the automatic devices and the controlled devices. The automatic devices are simply constituted by a calibrated suction vave which opens from the reservoir towards the intermediate chamber when a certain value of depression is reached. The controlled devices comprise one or more valves, the opening of which is mechanically triggered by the deflection of the diaphragm and which allow the re-fill only when said diaphragm is in a rearmost position.

Of the automatic systems, it can be said that they have the disadvantage of considerably reducing the suction capacity of the pump compared with that of a piston pump, and of presenting a risk of damage for the diaphragm in certain cases of operation if they are not coupled with complex and expensive systems of protection which also contribute to lowering the performance of the pump. The known controlled systems comprise either a slide valve which is actuated by the diaphragm over a short stroke, and therefore present small lap sliding surfaces lacking in reliability and tightness, or mechanical control devices using a linkage system requiring much power and presenting risks of jamming when being opened, and of being inopportunely kept open, this making it necessary to associate them to non-return valves which introduce a loss of load slowing down the re-filling and being able in certain cases to create real hydraulic jammings if the circuits are perfectly tight. These rod systems are only used in heavy duty pumps where the forces involved are high and where there is no need for either great accuracy or particularly high suction performances.

It is the object of the present invention to overcome the aforesaid disadvantages by proposing a compensation device which is inexpensive to produce and safe and simple to work whilst ensuring the best possible performances to the suction of the pump over a wide range of flow rates, as well as guaranteeing against any excessive deformations of the diaphragm in all stages of operation.

To this effect, the invention proposes a hydraulically-controlled diaphragm pump comprising a pumping chamber of variable volume of which one wall is constituted by a deformable diaphragm, an intermediate chamber filled with fluid, defined by a fixed enclosure of which one longitudinal end wall is constituted by the said diaphragm whereas another wall is constituted by a piston mounted for sliding inside the said enclosure and adapted to be actuated with a reciprocating movement inside the said enclosure, of predetermined stroke and frequency, adjustable in relation to the rate of flow required for the pump, a conduit for re-filling the said intermediate chamber connected to a reservoir of fluid, and a controlled member for opening and closing said conduit. According to one of the main features of the invention, the said controlled member is constituted by a valve which cooperates with a fixed seat through which the said conduit reaches into the said intermediate chamber, and which is mounted for sliding on a mobile train comprising a slide rod for said valve, said rod being also mounted for sliding longitudinally inside a support integral with the enclosure of the said intermediate chamber and traversing the said seat, a shoulder integral with the said rod forming a priming means for the valve and a means to hold it on its seat, and an actuating surface integral with the said rod and situated opposite to the said shoulder with respect to the said seat, on which surface the diaphragm can rest in its back position, the said mobile train being returned towards the said membrane in its conduit-closing position, by way of a spring coupled between the said support and the said mobile train.

In preferred manner, the mobile train will be placed along the longitudinal axis of the intermediate chamber perpendicular to the diaphragm in its center.

Advantageously, according to a preferred embodiment of the invention, the said support for the mobile train is an element which is removably fitted in the intermediate chamber the enclosure of which comprises to this effect a housing centered on the said axis, which is provided with at least one longitudinal orifice to allow the fluid through.

The invention will be more readily understood on reading the following description with reference to the accompanying drawings in which.

Figure 1:
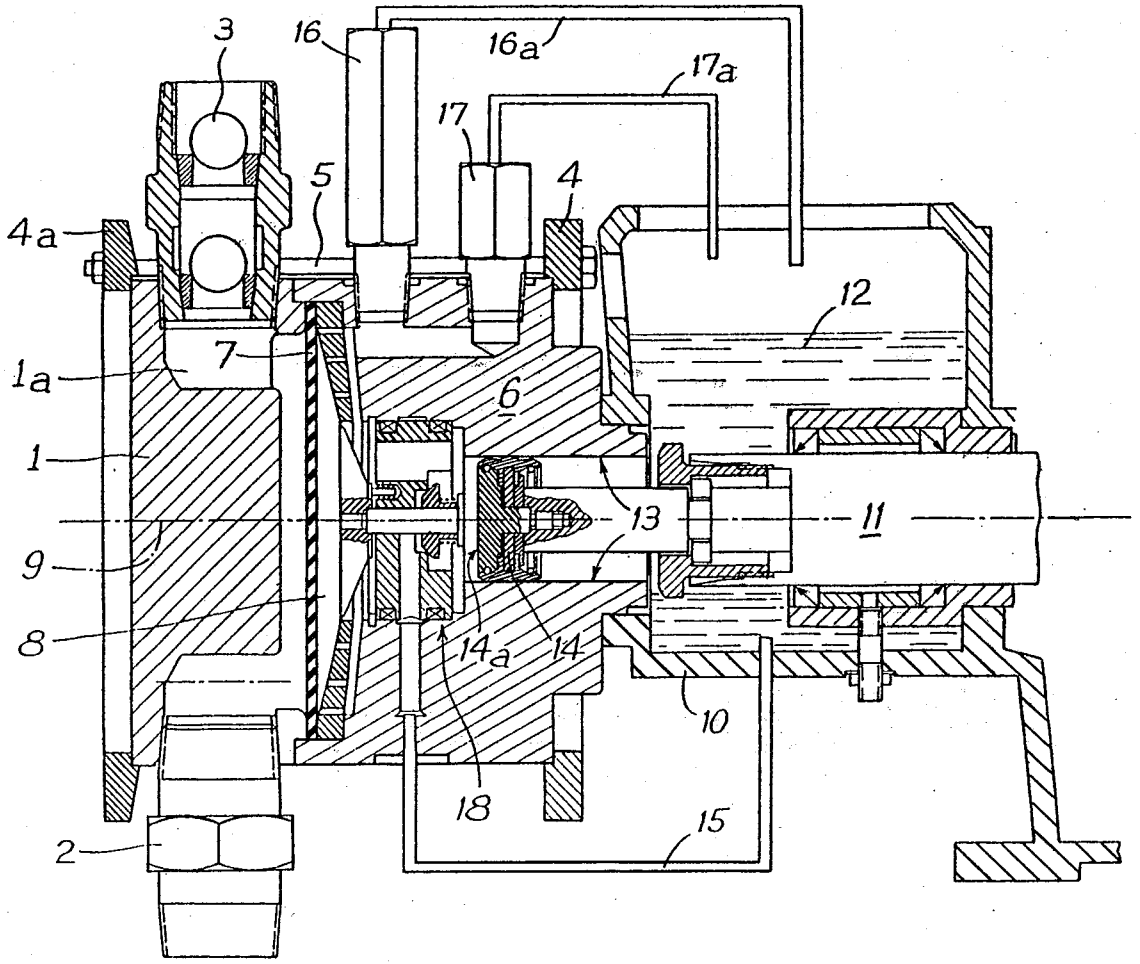
FIG. 1 is a longitudinal section of the pump according to the invention.

Referring first to FIG. 1, there is shown a pump which comprises an enclosure 1 defining a pumping chamber 1*a* provided with a suction valve 2 and with a delivery valve 3.

Said enclosure is joined by means of clamps 4 and 4*a* and of a series of stay-bars 5 to the pump body 6 with interposition of a flexible diaphragm 7 which seals off the chamber 1*a* whilst constituting a deformable wall therefor, and constituting a longitudinal end wall for an intermediate chamber 8 inside the pump body 6, with a longitudinal axis 9 which is perpendicular in its center to the diaphragm 7. Said body 6 is itself joined to the pump driving mechanism (not shown), via a housing 10 through which passes, in tight manner, a piston carrier 11 moving to-and-fro over a fixed or variable stroke under the action of any type of conventional driving means, such as for example a crank-connecting rod system.

The housing 10 is filled with a suitable liquid 12 such as a fluid mineral oil or water.

The body 6 comprises a bore 13 in which slides a piston 14, fast with the piston-carrier 11. The front face 14*a* of said piston constitutes a movable wall for the intermediate chamber 8. And it is thus obvious that to slide the piston 14 inside the bore 13, the chamber 8 being filled with fluid, causes the deformation of the diaphragm towards the inside of the pumping chamber 1 or towards the inside of the intermediate chamber 8, thereby reducing the volume of the said pumping chamber and creating a suction or a discharge.

To compensate for the leaks of fluid from the chamber 8, it is necessary to provide a conduit 15 connected to the housing reservoir 10 to re-fill the said chamber 8. Also, there is shown in 16 and 17 a safety valve and a bleeder, the discharges from which are taken to the housing 10 via pipes 16*a* and 17*a*.

Figure 2:
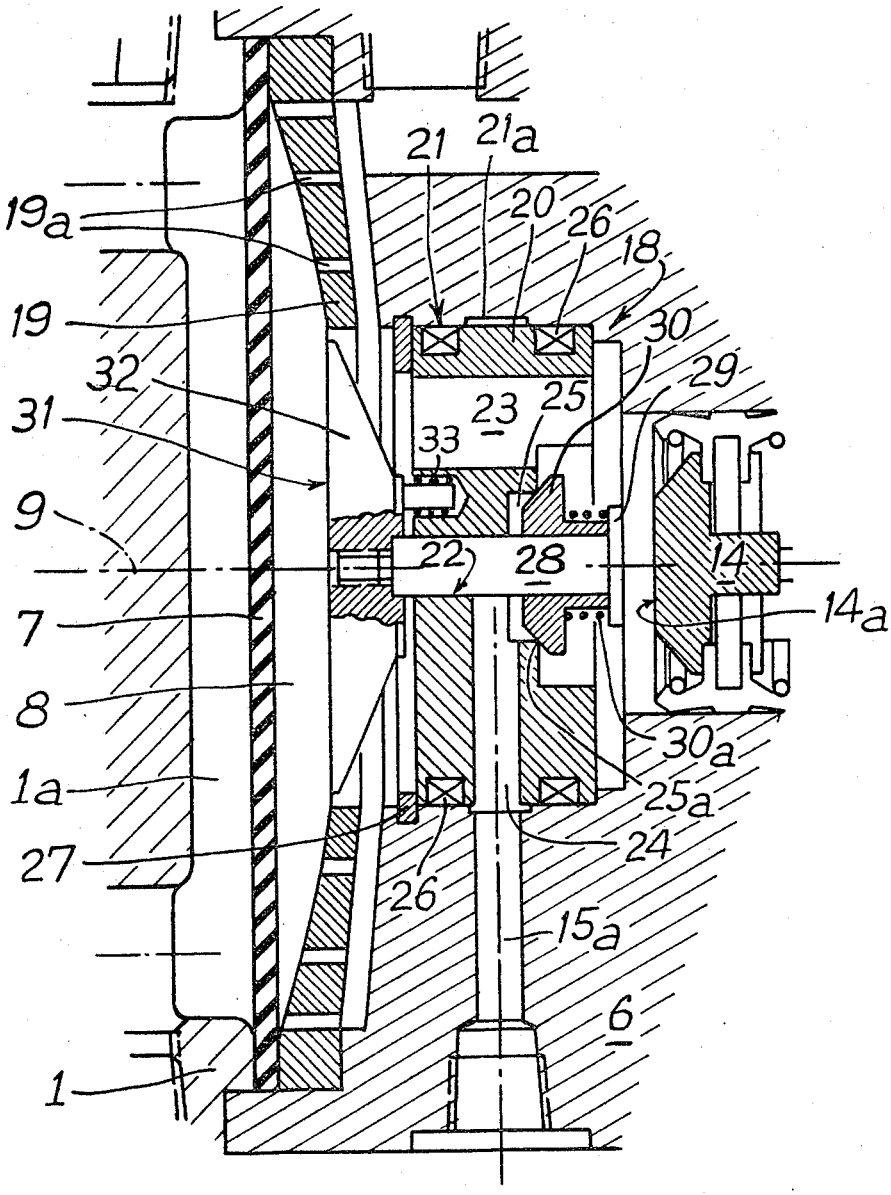
FIG. 2 is an enlarged detailed view of the compensation device used in the pump shown in FIG. 1.

A mechanism 18 is placed inside the chamber 8 to control the opening and closing of the re-filling conduit 15, which mechanism is shown in more details in FIG. 2.

Said FIG. 2 also shows some of the elements already described with reference to FIG. 1, with the same reference numbers. It will first of all be noted that, in known manner, there is provided in the intermediate chamber 8 a supporting plate 19 which is provided with perforations 19*a*, and extends behind the diaphragm 7, thereby constituting a rear abutment for the latter during the suction phase. Also, the re-filling pipe 15 reaches by its end 15*a* radially into the chamber 8.

The mechanism controlling the opening and closing of the re-fill conduit 15 comprises a generally cylindrical support block 20 which is fixed inside a housing 21 provided in the pump body 6 which housing comprises a peripheral groove 21*a* into which issues the end 15*a* of the conduit 15. Said supporting block 20 comprises a longitudinal bore 22 centered on the axis 9 and a plurality of longitudinal orifices 23 through which the fluid contained in the chamber 8 can flow without restriction. In addition, a radial channel 24 is provided in the support 20 from its peripheral surface opposite the groove 21*a* to a back recess 25 co-axial to the bore 22. Said support 20 is provided with sealing elements 26 between its peripheral bearing surface and the housing 21. A circlip 27 holds the said support axially inside its housing. It will be noted on this point that the support 20 is very easy of access. It suffices indeed to dismount the front part of the pump (1,7 and 19) to act on the circlip 27 and to remove the said support 20. This making the said support block very easy to fit in or to dismantle.

In the bore 22 is slidably mounted a rod 28 of a mobile train which comprises an end shoulder 29 serving as an abutment for a valve 30 of which the seat is an inner shoulder 25*a* of the recess 25, which valve is mounted for sliding on the rod 28 and can be urged leftwards by the spring 30*a*, said spring not being essential to the invention and being fitted only in certain exceptional cases specified hereinafter. At the opposite end, i.e. front side of the rod 28, the mobile train comprises an actuating surface 31 constituted by the front face of a plate 32 fast with the rod 28. The mobile train is urged towards the left by the effect of one or more springs such as 33 provided between the support 20 and the plate 32. The axial play provided at construction for the assembly is very small, about 1 mm for a wide range of flow rates which can vary between 0.1 and 10 m3/hour per pumping head.

Only a description of how the means controlling the opening and closing of the conduit re-filling the chamber 8 work, will be given hereafter, the working of the pump itself having been briefly recalled hereinabove.

At the start, the chamber 8 of the body 6 is supposedly entirely filled with oil (or water) and bled, the quantity being such that the diaphragm 7 abuts the plate 19 when the piston 14 is in its end-of-backstroke position. The oil is supposed to be flowing freely between the piston and the diaphragm through the different orifices 23, 19*a* and towards the valve 16 and the automatic bleeder 17. On the contrary, the communication between the chamber 8 and the housing 10 is cut off due to the fact that the valve 30 is on its seat 25*a*. The circuit 15, 15*a*, 24 and 25 is obviously, likewise, full of fluid.

When the pump mechanism causes the piston to move to-and-fro, this causes a deformation of the diaphragm 7 and a variation of the volume of the chamber 1*a* which is equal to the cubic capacity swept by the piston, this causing the suction and forcing back of the liquid to be pumped, through the valves 2 and 3. This illustrates the ideal theoretical functioning, which presupposes that the volume of oil contained in the intermediate chamber 8 remains constant and that the diaphragm is capable to be deformed without abutting whilst sweeping the entire cubic capacity. In these conditions, the suction pressure and the delivery pressure are exactly transmitted from the chamber 1*a* to the chamber 8, disregarding the stiffness of the diaphragm and the losses of load.

It is obvious that, during the delivery phase, wherein the chamber 8 is pressurized, the valve 30 remains closed and the rod 28 which is nearly entirely balanced hydraulically, remains constantly urged back towards the left under the effect of the spring 33. Any leaks occurring along the mobile train can only be negligeable. And this could be completely eliminated by placing an O-ring on the rod 28 in case of very strong delivery pressures.

During the suction phase, the chamber 8 is depressurized and it is obvious that the mobile train 28, 29, 32, is urged towards the right by a force which is equal to the value of the depression multiplied by the section between the shoulder 25*a* and the rod 28. Therefore, for the valve to remain closed (disregarding the very weak spring 30*a*, if one is provided), the force of the spring 33 only needs to be greater than the aforesaid value in every case of operation. The housing 10 being exposed to the air, i.e. in practice at 1 absolute bar, it is sufficient, if F is the force of the spring in decanewton and S is the differential section of the valve in cm2, to have $F > S$. In these conditions, it is possible even, to create a total vacuum inside the chamber 8 without the oil of the housing 10 being sucked in again, this therefore permitting to obtain performances at the suction end of the pump which are much superior to the performances of pumps with automatic filling by depression. In addition and for the same reason, it is impossible for the diaphragm to be damaged by the introduction of an excess of oil which would urge it unduly forward since filling is impossible as long as the diaphragm is not in rear abutment during suction and that an acceptable deformation from that position should be superior to the cubic capacity.

In use, slight oil leaks occur towards the housing 10 during the compression cycles: through the automatic bleeder 17 and in some cases on the periphery of the piston 14 and along the rod 28. Also, if an excess pressure occurs accidentally, the safety valve 16, which protects the pump, discharges large quantity which can reach the whole cubic capacity. The volume of fluid in the chamber 8 decreases and the diaphragm 7 comes into rear abutment on the plate 19 during the suction stroke. When the piston 14 continues to move rearward, the pressure inside the chamber 8 becomes less than the pressure inside the pumping chamber 1*a*. As a result, the force pressing the diaphragm against the actuating surface 31 of the plate 32 is equal to the product of the section of the plate by the differential pressure. As soon as said force becomes sufficient to overcome the difference between the force of the spring 33 and the thrust towards the right of the valve 30, the plate is pushed back and the valve is opened, placing the intermediate chamber 8 in communication with the housing 10 via the conduit 15, 15*a*, 24, 25, this permitting the admission of the fluid into the said chamber. On the return stroke of the piston, the valve 30 closes as soon as the pressure increases again in the chamber 8, before even that the plate 32 returns towards the front due to the fact that said valve 30 is mounted for sliding on the rod 28. There is therefore no need for a non-return valve to be provided on the circuit 15, 15*a*, 24, this presenting a great advantage over the controlled compensation systems known up to now. Immediately the valve 30 is closed again, the forward movement of the piston detaches the diaphragm, the plate 32 returns to the front position and another stroke of normal compression can start, the chamber 8 being once again filled with the correct quantity of oil. After large discharge through the safety valve, this re-filling can take a few back-and-forth strokes of the piston before the flow is back to its nominal value; but in normal operation, in the case of slow leaks from the piston or from the bleeder, the valve 30 is raised and the plate shifted of only a very small amount, and the quantity of liquid admitted at each cycle is negligeable in view of the cubic capacity. Moreover, the diaphragm comes into contact with the plate 32 at each cycle at the end of the suction, this making all damages by frontward deformation impossible, and all the systems of protection by abutments or double diaphragms unnecessary, the disadvantages of such systems of protection, where especially the pumping up of filled or viscous liquids is concerned, being well known.

Another advantage of the system is that it compensates for leaks without the risk of insufficient or excessive re-filling for very low values of suction pressure.

Indeed, by way of example, it will be presumed that the valve 30 has a differential section (between the shoulder 25*a* and the rod 28) of 5 cm2 and that the plate 32 has an actuating surface of 50 cm2, these values corresponding to a pump of average range. Admitting that a complete vacuum is created in the chamber 8, the force exerted by the valve 30 will be 5 decanewtons, 1 decanewton has to be overcome to open it if the spring 33 releases the mobile train under 6 decanewtons, this constituting a good margin against all inopportune opening. From the moment when the diaphragm 7 is applied on the plate 32, it becomes obvious that a pressure of 0.02 absolute bar in the pumping head is sufficient to cause the opening of the valve 30 and to permit the compensation. This value is really low in comparison with the most severe conditions of suctions which can be created in practice in the diaphragm pumps known up to now. Indeed, in pumps with automatic compensation, the minimum acceptable value should be greater than the calibrating value of the single-directional valves used, i.e. about 0.5 absolute bar. In pumps using conventional type controlled valves, the plays and the friction of the control linkage systems necessitate in practice high suction pressure values and high cubic capacities, this limiting their use to pressurized circuits or to circuits with a low depression and to high rates of flow.

The device according to the invention is also suitable in the case of suction under pressure in which, in case of a sudden oil discharge through the safety valve under compression, the membrane 7 tends to push backwards, thus pushing back the plate 32 completely during the release stroke. Indeed, even in this case, the valve 30 closes back immediately the pressure goes over 1 absolute bar inside the intermediate chamber, this in practice occurring immediately the piston reverses strokes without a noticeable quantity of fluid being forced back into the housing 10.

Nevertheless, in the case of very low rates of flow and fast stroking rates, it is possible to speed up the closure by means of a very light spring 30*a*. This spring, of which the force is about 0.1 decanewton changes virtually nothing to the operation described hereinabove. Its only effect is to improve it in extreme conditions of low rate of flow and of strong suction pressure at the cost of a slight reduction of the suction power and of the re-filling speed in normal circumstances.

The invention is in no way limited to the description given hereinabove and on the contrary covers any modifications that can be brought thereto without departing from the scope thereof.

For example, the compensation block could be situated somewhere else but in the centre of the membrane and not be provided with passages if appropriate communications were provided to allow the flow of the fluid between the different parts of the intermediate chamber. The mobile train which constitutes the essential part of the invention could be mounted directly in a wall fast with the pump body 6 or with the supporting plate 19 instead of being pre-assembled in a separate unit, the advantage of the separate block being that it is easier to fit in, to replace or to maintain.

What is claimed is:

1. Hydraulically controlled diaphragm pump, comprising a pumping chamber of variable volume of which one wall is constituted by a deformable diaphragm, an intermediate chamber filled with fluid, defined by a fixed enclosure of which one longitudinal end wall is constituted by the said diaphragm whereas another wall is constituted by a piston mounted for sliding inside the said enclosure and adapted to be actuated with a reciprocating movement inside the said enclosure, of predetermined stroke and frequency, adjustable in relation to the rate of flow required for the pump, a conduit for re-filling the said intermediate chamber connected to a reservoir of fluid, and a controlled member for opening and closing said conduit; according to one of the main features of the invention, the said controlled member is constituted by a valve which cooperates with a fixed seat through which the said conduit reaches into the said intermediate chamber, and which is mounted for sliding on a mobile train comprising a slide rod for said valve, said rod being also mounted for sliding longitudinally inside a support integral with the enclosure of the said intermediate chamber and traversing the said seat, a shoulder integral with the said rod forming a priming means for the valve and a means to hold it on its seat, and an actuating surface integral with the said rod and situated opposite to the said shoulder with respect to the said seat, on which surface the diaphragm can rest in its back position, the said mobile train being returned towards the said membrane in its conduit-closing position, by way of a spring coupled between the said support and the said mobile train, wherein the said rod traverses the said seat, the said element being constituted by an end shoulder of the rod.

2. Diaphragm pump as claimed in claim 1, wherein the dimensions of the actuating surface, the serviceable section of the valve and the return force of said spring are determined so as to obtain the opening of the re-filling conduit for a difference of pressure between the pumping chamber and the intermediate chamber, equal to more than 0.1 bar.

3. Diaphragm pump as claimed in claim 1, wherein an auxiliary spring is inserted between the said shoulder of the mobile train and the said slide valve.

4. Diaphragm pump as claimed in claim 1, wherein said pump comprises, in known manner, a rear supporting surface for the diaphragm and wherein the said actuating surface forms a continuation of said supporting surface in the center of the latter, projecting slightly under the action of the mobile train return spring.

5. Diaphragm pump as claimed in claim 1, wherein the said support is an element which is removably fitted in the said intermediate chamber and is held in position in a housing of the said enclosure which is centered on the longitudinal axis of said intermediate chamber by means of a securing member accessible from the side of said diaphragm.

* * * * *

UNITED STATES PATENT AND TRADEMARK OFFICE

CERTIFICATE OF CORRECTION

PATENT NO. : 4,416,599

DATED : November 22, 1983

INVENTOR(S) : Jacques Huto DeLongchamp

It is certified that error appears in the above-identified patent and that said Letters Patent are hereby corrected as shown below:

Col. 1, line 24, delete "vave" and substitute -- valve --

Signed and Sealed this

*Third* Day of *July 1984*

[SEAL]

*Attest:*

GERALD J. MOSSINGHOFF

*Attesting Officer*

*Commissioner of Patents and Trademarks*